US011428216B2

(12) United States Patent
Takahashi

(10) Patent No.: US 11,428,216 B2
(45) Date of Patent: Aug. 30, 2022

(54) CRYOPUMP AND METHOD FOR CONTROLLING CRYOPUMP

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 377 days.

(21) Appl. No.: 16/725,384

(22) Filed: Dec. 23, 2019

(65) Prior Publication Data

US 2020/0132064 A1 Apr. 30, 2020

Related U.S. Application Data

(63) Continuation of application No. PCT/JP2018/022241, filed on Jun. 11, 2018.

(30) Foreign Application Priority Data

Jun. 23, 2017 (JP) ..... JP2017-122848

(51) Int. Cl.
*F04B 37/08* (2006.01)
*F04B 37/14* (2006.01)

(52) U.S. Cl.
CPC ..... *F04B 37/08* (2013.01); *F04B 37/14* (2013.01)

(58) Field of Classification Search
CPC ..... F04B 37/08; F04B 37/14
See application file for complete search history.

(56) References Cited

U.S. PATENT DOCUMENTS

| | | | | |
|---|---|---|---|---|
| 9,068,564 | B2 * | 6/2015 | Kimura | F04B 37/08 |
| 9,415,325 | B2 * | 8/2016 | Fukuda | F04B 37/08 |
| 2013/0160468 | A1 | 6/2013 | Kimura | |
| 2014/0230461 | A1 | 8/2014 | Takahashi | |
| 2015/0152856 | A1 | 6/2015 | Kiumra | |

FOREIGN PATENT DOCUMENTS

| | | | |
|---|---|---|---|
| JP | 2004-027866 | A | 1/2004 |
| JP | 2004027866 | A * | 1/2004 |
| JP | 4912438 | B2 | 4/2012 |
| JP | 2013-134020 | A | 7/2013 |
| JP | 2014-156831 | A | 8/2014 |
| WO | WO-2010-097888 | A1 | 9/2010 |

* cited by examiner

*Primary Examiner* — Lionel Nouketcha
(74) *Attorney, Agent, or Firm* — Michael Best & Friedrich LLP

(57) ABSTRACT

A cryopump includes: a first-stage cryopanel; a second-stage cryopanel; a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature; and a cryocooler controller configured to execute first-stage temperature control for controlling the first-stage cooling temperature to a first-stage target temperature and increase the cooling capacity of the cryocooler when an increase in the second-stage cooling temperature is detected during the execution of the first-stage temperature control.

10 Claims, 8 Drawing Sheets

CRYOPUMP AND METHOD FOR CONTROLLING CRYOPUMP

RELATED APPLICATIONS

The contents of Japanese Patent Application No. 2017-122848, and of International Patent Application No. PCT/JP2018/022241, on the basis of each of which priority benefits are claimed in an accompanying application data sheet, are in their entirety incorporated herein by reference.

BACKGROUND

Technical Field

Certain embodiments of the present invention relate to a cryogenic pump and a method for controlling a cryogenic pump.

Description of Related Art

A cryogenic pump is a vacuum pump which captures gas molecules on a cryopanel cooled to a cryogenic temperature by condensation or adsorption to exhaust the gas molecules. The cryogenic pump is generally used to realize a clean vacuum environment which is required for a semiconductor circuit manufacturing process or the like.

SUMMARY

According to an embodiment of the present invention, there is provided a cryopump including: a first-stage cryopanel; a second-stage cryopanel; a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature; and a cryocooler controller configured to execute first-stage temperature control for controlling the first-stage cooling temperature to a first-stage target temperature and increase cooling capacity of the cryocooler when an increase in the second-stage cooling temperature is detected during the execution of the first-stage temperature control.

According to another embodiment of the present invention, there is provided a method for controlling a cryopump, the cryopump including a first-stage cryopanel, a second-stage cryopanel, and a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature, the method including: executing first-stage temperature control for controlling the first-stage cooling temperature to a first-stage target temperature; and increasing cooling capacity of the cryocooler when an increase in the second-stage cooling temperature is detected during the execution of the first-stage temperature control.

According to still another embodiment of the present invention, there is provided a cryopump including: a first-stage cryopanel; a second-stage cryopanel; a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature; and a cryocooler controller configured to execute second-stage temperature control for controlling the second-stage cooling temperature to a second-stage target temperature and determine whether or not the first-stage cooling temperature is in a temperature range between a predetermined first-stage lower limit temperature and a predetermined first-stage upper limit temperature, during the execution of the second-stage temperature control.

DETAILED DESCRIPTION

Figure 1:
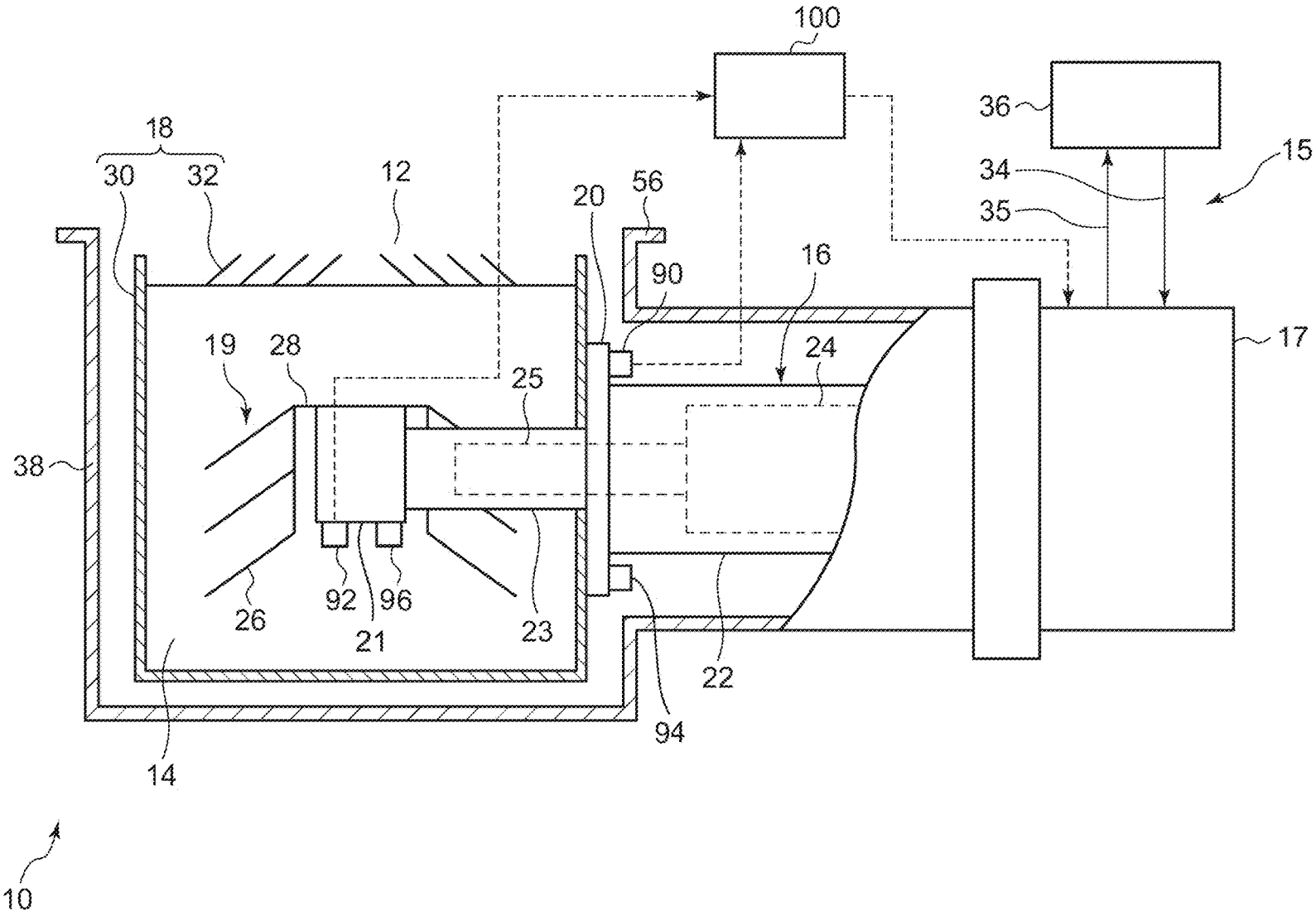
FIG. 1 is a diagram schematically showing a cryogenic pump according to an embodiment.

In a case where the exhaust performance of the cryogenic pump deteriorates due to long-term use, it is recommended to perform maintenance such as repair of the cryogenic pump or replacement with a new cryogenic pump. However, depending on the use of the cryogenic pump, a time when the maintenance is possible is restricted. For example, in a case where the cryogenic pump is used in a factory facility, it is required to perform the maintenance at a planned timing so as to maximize the production efficiency of a product. Therefore, when there is a sign of deterioration in the exhaust performance of the cryogenic pump, it is desirable to continue the operation of the cryogenic pump while suppressing the deterioration in the exhaust performance, over a certain period of time thereafter or preferably until a planned maintenance time.

It is desirable to extend the life of a cryogenic pump to some extent.

Any combination of the constituent elements described above, or replacement of constituent elements or expressions of the present invention with each other between apparatuses, methods, systems, computer programs, recording media storing computer programs, or the like is also valid as an aspect of the present invention.

According to the present invention, it is possible to extend the life of the cryogenic pump to some extent.

Hereinafter, modes for carrying out the present invention will be described in detail with reference to the drawings. In the description and the drawings, identical or equivalent constituent elements, members, and processing are denoted by the same reference numerals, and overlapping description is omitted appropriately. The scales or shapes of the respective parts shown in the drawings are set for convenience in order to facilitate description and are not interpreted to a limited extent unless otherwise specified. Embodiments are exemplification and do not limit the scope of the present invention. All features described in the embodiments or combinations thereof are not necessarily essential to the invention.

A typical cryogenic pump is cooled by a two-stage type cryocooler. Since it is not possible to make the operation frequency of the cryocooler different between a first stage and a second stage, the cooling capacity of the first stage and the second stage cannot be individually controlled. In a cryogenic pump, particularly a high-end cryogenic pump, temperature control is usually performed so as to maintain a cooling temperature of the first stage at a target temperature. Apart from a case where a controllable heater is installed at the first stage or the second stage of the cryocooler, a cooling temperature of the second stage is not controlled.

The cooling capacity of the cryocooler gradually deteriorates due to long-term use. The influence of the deterioration appears noticeably in the cooling capacity of the second stage having a lower temperature. For this reason, in a cryogenic pump that has been used for a long time, such an operation situation in which although a first-stage cooling temperature is maintained by control, a second-stage cooling temperature cannot be lowered to such an extent as in a new cryogenic pump can occur. If such a situation progresses and the second-stage cooling temperature rises to a certain limit, the exhaust capacity of the cryogenic pump cannot be guaranteed. In this case, it is recommended to perform maintenance such as repair of the cryogenic pump or replacement with a new cryogenic pump.

However, in a case where a cryogenic pump is used in a factory facility such as a semiconductor circuit manufacturing facility, a time when the maintenance of the cryogenic pump is possible is restricted. This is because in such factories, it is strongly required to perform maintenance at a planned timing so as to maximize the production efficiency of a product.

In order to avoid unforeseen maintenance, a cryogenic pump is also often replaced in a preventive manner at a planned maintenance time. This means that a cryogenic pump which has been operated soundly without any sign of deterioration is replaced with a new cryogenic pump. It is a waste because the remaining life of the cryogenic pump still having available capacity is not used and is wasted.

Therefore, a control device of a cryogenic pump according to an embodiment is configured to detect an increase in a second-stage cooling temperature during the execution of first-stage temperature control and increase the cooling capacity of the cryocooler. The control device detects an increase in the second-stage cooling temperature, which occurs during the execution of the first-stage temperature control, as a sign of deterioration in the performance of the cryogenic pump. In a case where such a sign is detected, the control device controls the cryocooler so as to enhance the cooling capacity after the point in time of the detection compared to the previous cooling capacity.

In this way, it is possible to delay an increase in the second-stage cooling temperature compared to a case where the first-stage temperature control is continued as it is without increasing the cooling capacity. It is possible to extend a time until the second-stage cooling temperature of the cryogenic pump reaches a limit temperature at which the maintenance of the cryogenic pump is required. In this way, it is possible to extend the life of the cryogenic pump to some extent. It becomes possible to continue the operation of the cryogenic pump while suppressing deterioration in exhaust performance, preferably until a planned maintenance time.

FIG. 1 is a diagram schematically showing a cryogenic pump 10 according to an embodiment. The cryogenic pump 10 is mounted to a vacuum chamber of, for example, an ion implanter, a sputtering apparatus, or the like and is used to increase the degree of vacuum in the interior of the vacuum chamber to a level which is required for a desired process.

The cryogenic pump 10 has an intake port 12 for receiving gas. The intake port 12 is an inlet to an internal space 14 of the cryogenic pump 10. The gas to be exhausted enters the internal space 14 of the cryogenic pump 10 through the intake port 12 from the vacuum chamber to which the cryogenic pump 10 is mounted.

In the following, there is a case where the terms "axial direction" and "radial direction" are used in order to express the positional relationship between constituent elements of the cryogenic pump 10 in an easily understandable manner. The axial direction represents a direction passing through the intake port 12, and the radial direction represents a direction along the intake port 12. For convenience, with respect to the axial direction, there is a case where the side relatively close to the intake port 12 is referred to as an "upper side" and the side relatively distant from the intake port 12 is referred to as a "lower side". That is, there is a case where the side relatively distance from the bottom of the cryogenic pump 10 is referred to as an "upper side" and the side relatively close to the bottom of the cryogenic pump 10 is referred to as a "lower side". With respect to the radial direction, there is a case where the side close to the center of the intake port 12 is referred to as an "inner side" and the side close to the peripheral edge of the intake port 12 is referred to as an "outer side". Such expressions are not related to the disposition when the cryogenic pump 10 is mounted to the vacuum chamber. For example, the cryogenic pump 10 may be mounted to the vacuum chamber with the intake port 12 facing downward in the vertical direction.

The cryogenic pump 10 includes a cooling system 15, a first-stage cryopanel 18, and a second-stage cryopanel 19. The cooling system 15 is configured to cool the first-stage cryopanel 18 and the second-stage cryopanel 19. The cooling system 15 includes a cryocooler 16 and a compressor 36.

The cryocooler 16 is a cryocooler such as a Gifford McMahon type cryocooler (a so-called GM cryocooler), for example. The cryocooler 16 is a two-stage type cryocooler which includes a first cooling stage 20, a second cooling stage 21, a first cylinder 22, a second cylinder 23, a first displacer 24, and a second displacer 25. Accordingly, a high-temperature stage of the cryocooler 16 includes the first cooling stage 20, the first cylinder 22, and the first displacer 24. A low-temperature stage of the cryocooler 16 includes the second cooling stage 21, the second cylinder 23, and the second displacer 25. Accordingly, in the following, the first cooling stage 20 and the second cooling stage 21 can also be respectively referred to as a low-temperature end of the high-temperature stage and a low-temperature end of the low-temperature stage.

The first cylinder 22 and the second cylinder 23 are connected in series. The first cooling stage 20 is installed at a joined portion between the first cylinder 22 and the second cylinder 23. The second cylinder 23 connects the first cooling stage 20 and the second cooling stage 21. The second cooling stage 21 is installed at the terminus of the second cylinder 23. The first displacer 24 and the second displacer 25 are respectively disposed in the interiors of the first cylinder 22 and the second cylinder 23 so as to be movable in a longitudinal direction (a right-and-left direction in FIG. 1) of the cryocooler 16. The first displacer 24 and the second displacer 25 are connected to each other so as to be integrally movable. A first regenerator and a second regenerator (not shown) are respectively incorporated into the first displacer 24 and the second displacer 25.

A drive mechanism 17 is provided at a room-temperature part of the cryocooler 16. The drive mechanism 17 is connected to the first displacer 24 and the second displacer 25 such that the first displacer 24 and the second displacer 25 can respectively reciprocate in the interiors of the first cylinder 22 and the second cylinder 23. Further, the drive mechanism 17 includes a flow path switching mechanism for switching a flow path for working gas so as to periodically repeat the suction and discharge of the working gas. The flow path switching mechanism includes, for example, a valve part and a drive part for driving the valve part. The valve part includes, for example, a rotary valve, and the drive part includes a motor for rotating the rotary valve. The motor may be, for example, an AC motor or a DC motor. Further, the flow path switching mechanism may be a direct-acting type mechanism which is driven by a linear motor.

The cryocooler 16 is connected to the compressor 36 through a high-pressure conduit 34 and a low-pressure conduit 35. The cryocooler 16 generates cold in the first cooling stage 20 and the second cooling stage 21 by expanding high-pressure working gas (for example, helium) which is supplied from the compressor 36 in the interior thereof. The compressor 36 recovers the working gas expanded in the cryocooler 16, pressurizes it again, and then supplies it to the cryocooler 16.

Specifically, first, the drive mechanism 17 makes the high-pressure conduit 34 and an internal space of the cryocooler 16 communication with each other. The high-pressure working gas is supplied from the compressor 36 to the cryocooler 16 through the high-pressure conduit 34. If the internal space of the cryocooler 16 is filled with the high-pressure working gas, the drive mechanism 17 switches the flow path so as to make the internal space of the cryocooler 16 communicate with the low-pressure conduit 35. In this way, the working gas expands. The expanded working gas is recovered to the compressor 36. The first displacer 24 and the second displacer 25 respectively reciprocate in the interiors of the first cylinder 22 and the second cylinder 23 in synchronism with the supply and discharge of the working gas. Such a thermal cycle is repeated, whereby the cryocooler 16 generates cold in the first cooling stage 20 and the second cooling stage 21.

The cryocooler 16 is configured to cool the first cooling stage 20 to a first-stage cooling temperature and cool the second cooling stage 21 to a second-stage cooling temperature. The second-stage cooling temperature is lower than the first-stage cooling temperature. For example, the first cooling stage 20 is cooled to a temperature in a range of about 60 K to 130 K, or about 65 K to 120 K, or preferably, 80 K to 100 K, and the second cooling stage 21 is cooled to a temperature in a range of about 10 K to 20 K.

The cryocooler 16 is configured to make the working gas flow to the low-temperature stage through the high-temperature stage. That is, the working gas flowing in from the compressor 36 flows from the first cylinder 22 to the second cylinder 23. At this time, the working gas is cooled to the temperature of the first cooling stage 20 by the first displacer 24 and the regenerator thereof. The working gas cooled in this way is supplied to the low-temperature stage.

The cryogenic pump 10 which is shown in the drawing is a so-called horizontal cryogenic pump. The horizontal cryogenic pump is generally a cryogenic pump in which the cryocooler 16 is disposed so as to intersect (usually, be orthogonal to) the axial direction of the cryogenic pump 10.

The second-stage cryopanel 19 is provided at a central portion of the internal space 14 of the cryogenic pump 10. The second-stage cryopanel 19 includes, for example, a plurality of cryopanel members 26. Each of the cryopanel members 26 has, for example, the shape of the side surface of a truncated cone, so to speak, an umbrella-like shape. An adsorbent (not shown) such as activated carbon is usually provided at each of the cryopanel members 26. The adsorbent is bonded to, for example, the back surface of the cryopanel member 26. In this way, the second-stage cryopanel 19 is provided with an adsorption region for adsorbing gas molecules.

The cryopanel member 26 is mounted to a cryopanel mounting member 28. The cryopanel mounting member 28 is mounted to the second cooling stage 21. In this way, the second-stage cryopanel 19 is thermally connected to the second cooling stage 21. Accordingly, the second-stage cryopanel 19 is cooled to the second-stage cooling temperature.

The first-stage cryopanel 18 includes a radiation shield 30 and an inlet cryopanel 32. The first-stage cryopanel 18 is provided outside the second-stage cryopanel 19 so as to surround the second-stage cryopanel 19. The first-stage cryopanel 18 is thermally connected to the first cooling stage 20, and the first-stage cryopanel 18 is cooled to the first-stage cooling temperature.

The radiation shield 30 is provided mainly to protect the second-stage cryopanel 19 from radiation heat from a housing 38 of the cryogenic pump 10. The radiation shield 30 is located between the housing 38 and the second-stage cryopanel 19 and surrounds the second-stage cryopanel 19. The radiation shield 30 is open toward the intake port 12 at an upper end thereof in the axial direction. The radiation shield 30 has a tubular shape (for example, a cylindrical shape) in which a lower end in the axial direction is closed, and is formed in the form of a cup. A hole for mounting of the cryocooler 16 is formed in the side surface of the radiation shield 30, and the second cooling stage 21 is inserted into the radiation shield 30 through the hole. The first cooling stage 20 is fixed to the outer surface of the radiation shield 30 at an outer peripheral portion of the mounting hole. In this way, the radiation shield 30 is thermally connected to the first cooling stage 20.

The inlet cryopanel 32 is provided above the second-stage cryopanel 19 in the axial direction and disposed along the radial direction in the intake port 12. The inlet cryopanel 32 is fixed to an opening end of the radiation shield 30 at an outer peripheral portion thereof and is thermally connected to the radiation shield 30. The inlet cryopanel 32 is formed in a louver structure or a chevron structure, for example. The inlet cryopanel 32 may be formed in the form of a concentric circle centered on the central axis of the radiation shield 30 or may be formed in other shapes such as a lattice shape.

The inlet cryopanel 32 is provided in order to exhaust gas entering the intake port 12. Gas (for example, moisture) which is condensed at the temperature of the inlet cryopanel 32 is captured on the surface of the inlet cryopanel 32. Further, the inlet cryopanel 32 is provided in order to protect the second-stage cryopanel 19 from the radiant heat from a heat source outside the cryogenic pump 10 (for example, a heat source in the vacuum chamber to which the cryogenic pump 10 is mounted). The entry of not only the radiant heat but also the gas molecules is restricted. The inlet cryopanel 32 occupies a part of the opening area of the intake port 12 so as to limit the inflow of gas into the internal space 14 through the intake port 12 to a desired amount.

The cryogenic pump 10 is provided with the housing 38. The housing 38 is a vacuum container for separating the inside of the cryogenic pump 10 from the outside. The housing 38 is configured to maintain the pressure in the internal space 14 of the cryogenic pump 10 in an airtight manner. The first-stage cryopanel 18 and the cryocooler 16 are accommodated in the housing 38. The housing 38 is provided outside the first-stage cryopanel 18 and surrounds the first-stage cryopanel 18. Further, the housing 38 accommodates the cryocooler 16. That is, the housing 38 is a cryogenic pump container which surrounds the first-stage cryopanel 18 and the second-stage cryopanel 19.

The housing 38 is fixed to the room-temperature part (for example, the drive mechanism 17) of the cryocooler 16 so as to be in non-contact with the first-stage cryopanel 18 and the low-temperature part of the cryocooler 16. The outer surface of the housing 38 is exposed to an external environment and has a higher temperature (for example, about room temperature) than the cooled first-stage cryopanel 18.

Further, the housing 38 is provided with an intake port flange 56 extending from the opening end thereof to the outside in the radial direction. The intake port flange 56 is a flange for mounting the cryogenic pump 10 to the vacuum chamber that is a mounting place. A gate valve (not shown) is provided in an opening of the vacuum chamber, and the intake port flange 56 is mounted to the gate valve. In this way, the gate valve is located above the inlet cryopanel 32 in the axial direction. For example, when regenerating the cryogenic pump 10, the gate valve is closed, and when the cryogenic pump 10 evacuates the vacuum chamber, the gate valve is opened.

The cryogenic pump 10 includes a first temperature sensor 90 for measuring the temperature of the first cooling stage 20, and a second temperature sensor 92 for measuring the temperature of the second cooling stage 21. The first temperature sensor 90 is mounted to the first cooling stage 20. The second temperature sensor 92 is mounted to the second cooling stage 21. The measured temperature of the first temperature sensor 90 represents the first-stage cooling temperature, and the measured temperature of the second temperature sensor 92 represents the second-stage cooling temperature. The first temperature sensor 90 may be mounted to the first-stage cryopanel 18. The second temperature sensor 92 may be mounted to the second-stage cryopanel 19.

Further, the cryogenic pump 10 includes a cryogenic pump control device (hereinafter also referred to as a control device) 100. The control device 100 may be provided integrally with the cryogenic pump 10 or may be configured as a control device separate from the cryogenic pump 10.

The control device 100 is configured to control the cryocooler 16 for an evacuation operation, a regeneration operation, and a cool-down operation of the cryogenic pump 10. The control device 100 is configured to receive the measurement results of various sensors which include the first temperature sensor 90 and the second temperature sensor 92. The control device 100 calculates a control command to be provided to the cryocooler 16, based on the measurement results.

The control device 100 controls the cryocooler 16 such that a cooling stage temperature follows a target cooling temperature. A target temperature of the first cooling stage 20 is normally set to a constant value. The target temperature of the first cooling stage 20 is determined, for example, as a specification according to a process which is performed in the vacuum chamber to which the cryogenic pump 10 is mounted. The target temperature may be changed as necessary during the operation of the cryogenic pump.

For example, the control device 100 controls an operation frequency of the cryocooler 16 by feedback control so as to minimize the deviation between the target temperature of the first cooling stage 20 and the measured temperature of the first temperature sensor 90. That is, the control device 100 controls a frequency of a thermal cycle (for example, a GM cycle) in the cryocooler 16 by controlling a motor rotation speed of the drive mechanism 17.

When a thermal load on the cryogenic pump 10 increases, the temperature of the first cooling stage 20 can increase. In a case where the measured temperature of the first temperature sensor 90 is higher than the target temperature, the control device 100 increases the operation frequency of the cryocooler 16. As a result, the frequency of the thermal cycle in the cryocooler 16 is also increased, and thus the first cooling stage 20 is cooled toward the target temperature. Conversely, in a case where the measured temperature of the first temperature sensor 90 is lower than the target temperature, the operation frequency of the cryocooler 16 is decreased, and thus the temperature of the first cooling stage 20 increases toward the target temperature. In this way, the temperature of the first cooling stage 20 can be maintained in a temperature range in the vicinity of the target temperature. The operation frequency of the cryocooler 16 can be appropriately adjusted according to the thermal load, and therefore, such control is helpful to a reduction in the power consumption of the cryogenic pump 10.

Controlling the cryocooler 16 such that the temperature of the first cooling stage 20 follows the target temperature is hereinafter often referred to as "first-stage temperature control". When the cryogenic pump 10 is performing the evacuation operation, normally, the first-stage temperature control is executed. As a result of the first-stage temperature control, the second cooling stage 21 and the second-stage cryopanel 19 are cooled to a temperature which is determined according to the specifications of the cryocooler 16 and a thermal load from the outside. Similarly, the control device 100 can also execute, so to speak, "second-stage temperature control" for controlling the cryocooler 16 such that the temperature of the second cooling stage 21 follows the target temperature.

Figure 2:
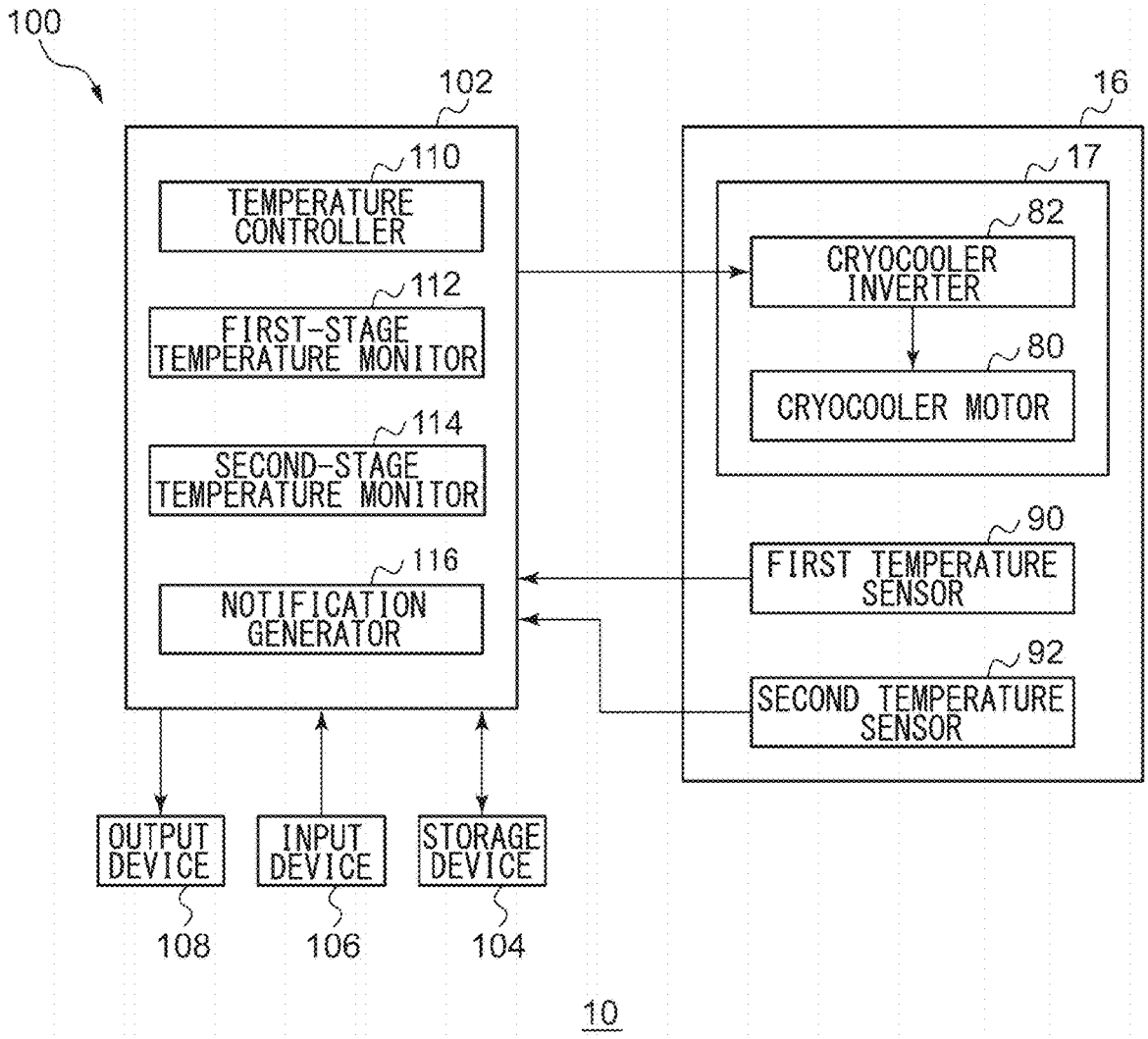
FIG. 2 is a diagram schematically showing a configuration of a control device of the cryogenic pump according to the embodiment.

FIG. 2 is a diagram schematically showing the configuration of the control device 100 of the cryogenic pump 10 according to the embodiment. Such a control device is realized by hardware, software, or a combination of these. The controller 100 is implemented in hardware such as a device or a circuit exemplified by a CPU, a processor, or a memory of a computer, and in software such as a computer program. Further, in FIG. 2, the configuration of a part of the relevant cryocooler 16 is schematically shown.

The drive mechanism 17 of the cryocooler 16 includes a cryocooler motor 80 for driving the cryocooler 16, and a cryocooler inverter 82 for controlling the operation frequency of the cryocooler 16. As described above, the cryocooler 16 is an expander for the working gas, and therefore, the cryocooler motor 80 and the cryocooler inverter 82 can also be respectively referred to as an expander motor and an expander inverter.

The operation frequency (also referred to as an operation speed) of the cryocooler 16 represents an operation frequency or a rotation speed of the cryocooler motor 80, an operation frequency of the cryocooler inverter 82, the frequency of the thermal cycle, or any one of them. The frequency of the thermal cycle is the number of times per unit time, of the thermal cycles which are performed in the cryocooler 16.

The control device 100 includes a cryocooler control unit or controller 102, a storage device 104, an input device 106, and an output device 108.

The cryocooler control unit 102 is configured to select and execute any one of the first-stage temperature control, the second-stage temperature control, and other cryopanel temperature control. The cryocooler control unit 102 is configured to detect an increase in the second-stage cooling temperature during the execution of the first-stage temperature control and increase the cooling capacity of the cryocooler 16. For example, the cryocooler control unit 102 is configured to detect an increase in the second-stage cooling temperature during the execution of the first-stage temperature control and switch from the first-stage temperature control to the second-stage temperature control.

The storage unit 104 is configured to store data related to the control of the cryogenic pump 10. The input unit 106 is configured to receive the input from a user or another device. The input unit 106 includes, for example, input means such as a mouse or a keyboard for receiving the input from the user, and/or communication means for performing communication with another device. The output unit 108 is configured to output data related to the control of the cryogenic pump 10 and includes output means such as a display or a printer.

Each of the storage unit 104, the input unit 106, and the output unit 108 is communicably connected to the cryocooler control unit 102. Accordingly, the cryocooler control unit 102 can read data from the storage unit 104 and/or store data in the storage unit 104, as necessary. Further, the cryocooler control unit 102 can receive data input from the input unit 106 and/or output data to the output unit 108.

The cryocooler control unit 102 includes a temperature control unit or controller 110, a first-stage temperature monitoring unit or monitor 112, a second-stage temperature monitoring unit or monitor 114, and a notification unit 116.

The temperature control unit 110 is configured to execute the first-stage temperature control and the second-stage temperature control and can select and execute either of the first-stage temperature control or the second-stage temperature control. The temperature control unit 110 is configured to switch from the first-stage temperature control to the second-stage temperature control or from the second-stage temperature control to the first-stage temperature control, based on the current state of the cryogenic pump 10 (for example, the temperature of the first-stage cryopanel 18 and/or the second-stage cryopanel 19).

The temperature control unit 110 is configured to determine the operation frequency of the cryocooler motor 80 as a function of the deviation between the measured temperature and the target temperature of the cryopanel (for example, by PID control), as described above. The temperature control unit 110 determines the operation frequency of the cryocooler motor 80 within an operation frequency range determined in advance. The operation frequency range is defined by an upper limit and a lower limit of the operation frequency determined in advance. The temperature control unit 110 outputs the determined operation frequency to the cryocooler inverter 82.

The cryocooler inverter 82 is configured to provide variable frequency control of the cryocooler motor 80. The cryocooler inverter 82 converts input power so as to have the operation frequency input from the temperature control unit 110. The input power to the cryocooler inverter 82 is supplied from a cryocooler power supply (not shown). The cryocooler inverter 82 outputs the converted power to the cryocooler motor 80. In this way, the cryocooler motor 80 is driven with the operation frequency determined by the temperature control unit 110 and output from the cryocooler inverter 82.

In this manner, in a case where the refrigerating capacity of the cryocooler 16 is controlled with an inverter method, the second-stage cooling temperature is not directly controlled in the first-stage temperature control. In the first-stage temperature control, the second-stage cooling temperature is determined by the cooling capacity of the second stage of the cryocooler 16 and the thermal load applied from the outside to the second cooling stage 21. Similarly, in the second-stage temperature control, the first-stage cooling temperature is not directly controlled. In the second-stage temperature control, the first-stage cooling temperature is determined by the cooling capacity of the first stage of the cryocooler 16 and the thermal load applied from the outside to the first cooling stage 20.

The cooling capacity of the cryocooler 16 may be controlled by a heater method or a combination of an inverter method and a heater method. The temperature control unit 110 may control a heater attached to the cryocooler 16 together with the operation frequency of the cryocooler motor 80 (or instead of the operation frequency of the cryocooler motor 80). As shown in FIG. 1, the cryocooler 16 may be provided with a first heater 94 mounted to the first cooling stage 20 (or the first-stage cryopanel 18) so as to heat the first cooling stage 20 and the first-stage cryopanel 18. Further, the cryocooler 16 may be provided with a second heater 96 mounted to the second cooling stage 21 (or the second-stage cryopanel 19) so as to heat the second cooling stage 21 and the second-stage cryopanel 19. In a case where the cryocooler 16 is provided with a heater, the first-stage cooling temperature and the second-stage cooling temperature can be individually controlled in the first-stage temperature control and the second-stage temperature control.

In a case where the refrigerating capacity of the cryocooler 16 is controlled with the inverter method, the first heater 94 and the second heater 96 may not be provided in the cryocooler 16.

The first-stage temperature monitoring unit 112 is configured to determine whether or not the first-stage cooling temperature is equal to or higher than a predetermined first-stage lower limit temperature T1min. The first-stage temperature monitoring unit 112 may determine whether or not the first-stage cooling temperature is equal to or higher than the predetermined first-stage lower limit temperature T1min, during the execution of the second-stage temperature control.

The first-stage lower limit temperature T1min corresponds to the lowest temperature which is allowed as the first-stage cooling temperature during the evacuation operation of the cryogenic pump 10. For example, in a case where main gases to be exhausted by the cryogenic pump 10 are water, argon, and xenon, water is exhausted by the first-stage cryopanel 18, and argon and xenon are exhausted by the second-stage cryopanel 19. If the temperature of the first-stage cryopanel 18 is excessively low, argon and xenon that should be condensed on the second-stage cryopanel 19 can be condensed on the first-stage cryopanel 18 as well. However, this can cause abnormal behavior of the cryogenic pump 10, and therefore, it should be prevented. When the degree of vacuum that should be realized by the cryogenic pump 10 is $10^{-8}$ Pa, it can be seen from the vapor pressure diagrams of various gases that the first-stage cooling temperature is preferably in a range of 60 K to 130 K.

Therefore, the first-stage lower limit temperature T1min may be selected from a temperature range of about 60 K to about 65 K, for example. The first-stage lower limit temperature T1min can be set to 60 K, for example. The first-stage lower limit temperature T1min may be set to 65 K, for example.

The second-stage temperature monitoring unit 114 is configured to determine whether or not the second-stage cooling temperature is equal to or lower than a predetermined second-stage upper limit temperature T2max. The second-stage temperature monitoring unit 114 may determine whether or not the second-stage cooling temperature is equal to or lower than the predetermined second-stage upper limit temperature T2max, during the execution of the first-stage temperature control.

It is desirable that the second-stage cooling temperature is maintained in a temperature range of, for example, about 10 K to about 15 K, preferably about 11 K to about 13 K. Therefore, the second-stage upper limit temperature T2max may be selected from a temperature range of about 14 K to about 20 K, or from a temperature range of about 15 K to about 17 K, for example. The second-stage upper limit temperature T2max may be set to 15 K, for example. The second-stage upper limit temperature may be set to 14 K, for example.

The notification generator 116 is configured to notify the user of the switching from the first-stage temperature control to the second-stage temperature control. The notification generator 116 generates a first switching notification signal and outputs it to the output unit 108, in a case where the switching from the first-stage temperature control to the second-stage temperature control has been performed in the temperature control unit 110. If the output unit 108 receives the first switching notification signal, the output unit 108 displays, on a display, the fact that the switching from the first-stage temperature control to the second-stage temperature control has been performed, or notifies the user of it with another method.

Further, the notification unit 116 is configured to notify the user of the switching from the second-stage temperature control to the first-stage temperature control. The notification unit 116 generates a second switching notification signal and outputs it to the output unit 108, in a case where the switching from the second-stage temperature control to the first-stage temperature control has been performed in the temperature control unit 110. If the output unit 108 receives the second switching notification signal, the output unit 108 displays, on a display, the fact that the switching from the second-stage temperature control to the first-stage temperature control has been performed, or notifies the user of it with another method.

The evacuation operation of the cryogenic pump 10 having the above configuration will be described below. When the cryogenic pump 10 is operated, first, the interior of the vacuum chamber is roughed to about 1 Pa with another appropriate roughing pump before the operation. Thereafter, the cryogenic pump 10 is operated. The first cooling stage 20 and the second cooling stage 21 are respectively cooled to the first stage cooling temperature and the second-stage cooling temperature by the driving of the cryocooler 16. Accordingly, the first-stage cryopanel 18 and the second-stage cryopanel 19 thermally coupled to these are also respectively cooled to the first-stage cooling temperature and the second-stage cooling temperature.

The inlet cryopanel 32 cools the gas which comes flying from the vacuum chamber toward the cryogenic pump 10. A gas having a sufficiently low vapor pressure (for example, $10^{-8}$ Pa or less) at the first-stage cooling temperature condenses on the surface of the inlet cryopanel 32. This gas may be referred to as a type 1 gas. The type 1 gas is, for example, water vapor. In this way, the inlet cryopanel 32 can exhaust the type 1 gas. A part of a gas in which vapor pressure is not sufficiently low at the first-stage cooling temperature enters the internal space 14 from the intake port 12. Alternatively, the other part of the gas is reflected by the inlet cryopanel 32 and does not enter the internal space 14.

The gas that has entered the internal space 14 is cooled by the second-stage cryopanel 19. A gas having a sufficiently low vapor pressure (for example, $10^{-8}$ Pa or less) at the second-stage cooling temperature condenses on the surface of the second-stage cryopanel 19. This gas may be referred to as a type 2 gas. The type 2 gas is, for example, argon. In this way, the second-stage cryopanel 19 can exhaust the type 2 gas.

A gas in which vapor pressure is not sufficiently low at the second cooling temperature is adsorbed by the adsorbent of the second-stage cryopanel 19. This gas may be referred to as a type 3 gas. The type 3 gas is, for example, hydrogen. In this way, the second-stage cryopanel 19 can exhaust the type 3 gas. Therefore, the cryogenic pump 10 can exhaust various gases by condensation or adsorption and can make the degree of vacuum of the vacuum chamber reach a desired level.

Figure 3:
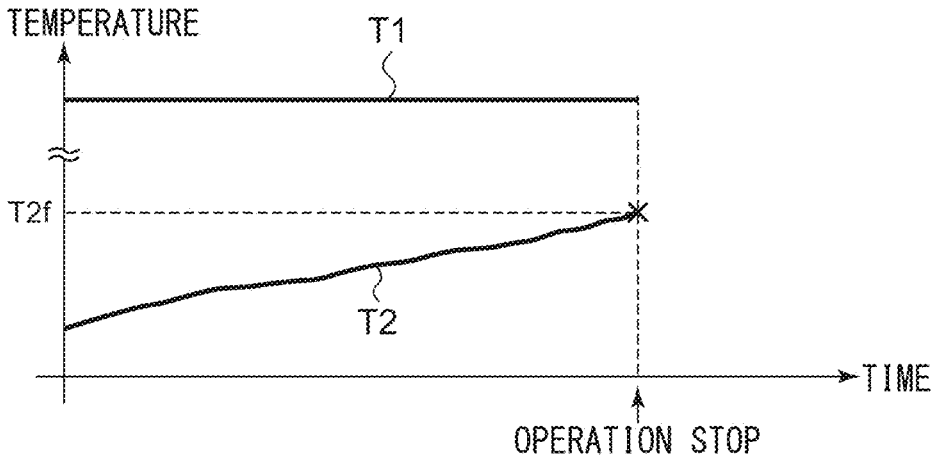
FIG. 3 is a diagram showing an example of a temperature profile which can be taken as a result of using a typical cryogenic pump for a long period of time.

FIG. 3 is a diagram showing an example of a temperature profile which can be taken as a result of using a typical cryogenic pump for a long period of time. The vertical and horizontal axes in FIG. 3 respectively represent temperature and time. FIG. 3 schematically shows temporal changes of a first-stage cooling temperature T1 and a second-stage cooling temperature T2.

As described above, the cooling capacity of a cryocooler that cools a cryogenic pump gradually deteriorates due to long-term use. As a result, as shown in FIG. 3, although the first-stage cooling temperature T1 is maintained by control, the second-stage cooling temperature T2 gradually increases. Such a temperature rising tendency reflects the deterioration of the cooling capacity of the cryocooler. Accordingly, the temperature rising tendency of the second stage becomes more remarkable as the deterioration of the cryogenic pump progresses with an increase in the operation period of the cryogenic pump. The exhaust capacity of the second stage of the cryogenic pump can become insufficient as the second-stage cooling temperature T2 increases.

In order to prevent the semiconductor circuit manufacturing facility to which the cryogenic pump is installed from being operated in a state where the exhaust capacity of the cryogenic pump is insufficient, in a typical cryogenic pump, if the second-stage cooling temperature T2 reaches an operation stop temperature T2*f*, the operation is stopped and maintenance is performed. The operation stop temperature T2*f* may be a temperature of 17 K or higher, for example. If such an operation stop occurs, the production facility must also be stopped, and therefore, it is not preferable. It is desirable that the maintenance of the cryogenic pump is performed at a timing when the influence on a semiconductor product manufacturing plan can be minimized. It is desirable to extend the life of the cryogenic pump to a timing when such maintenance can be performed.

Figure 4:
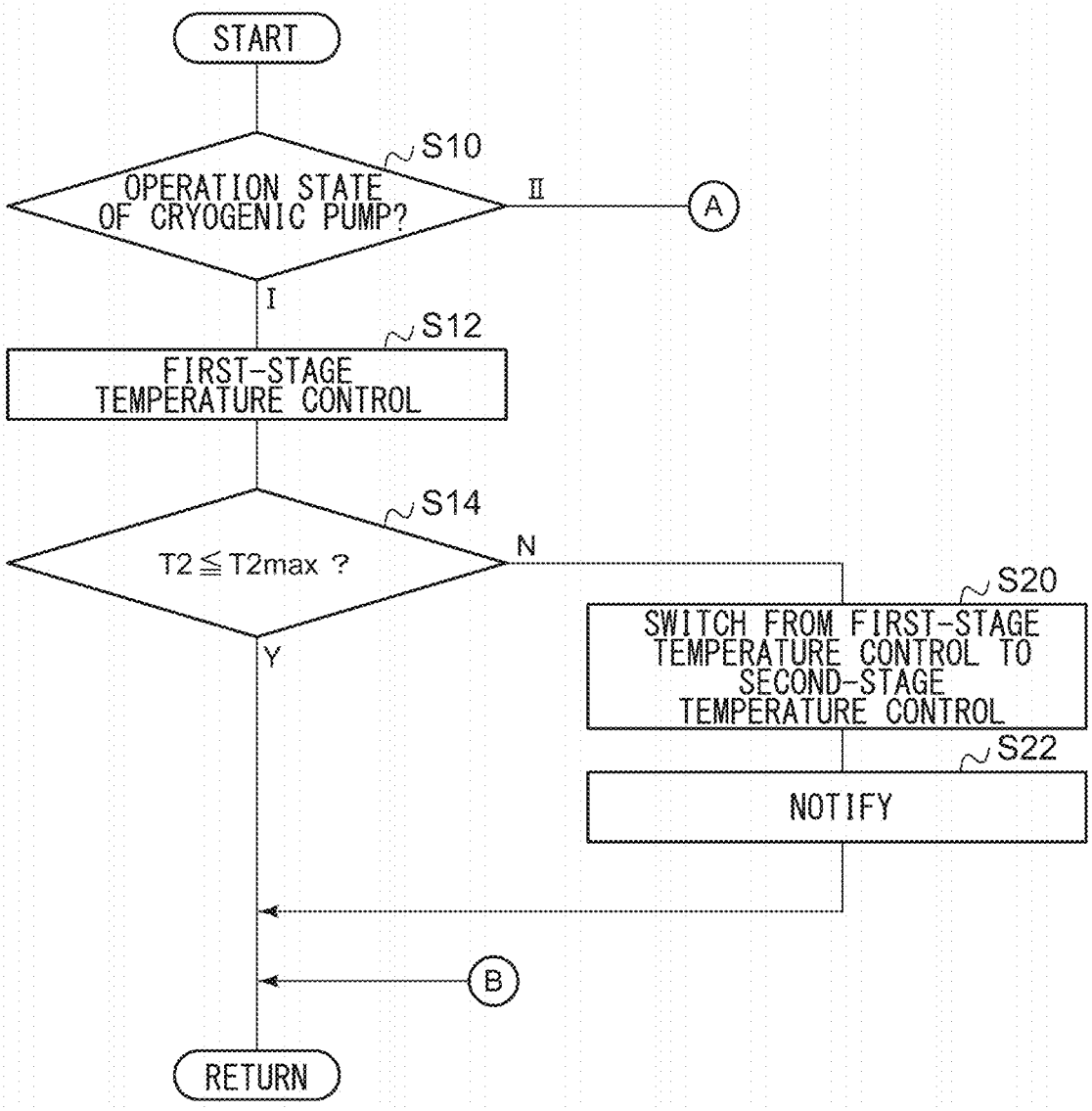
FIG. 4 is a flowchart showing a cryogenic pump control method according to an embodiment.
Figure 5:
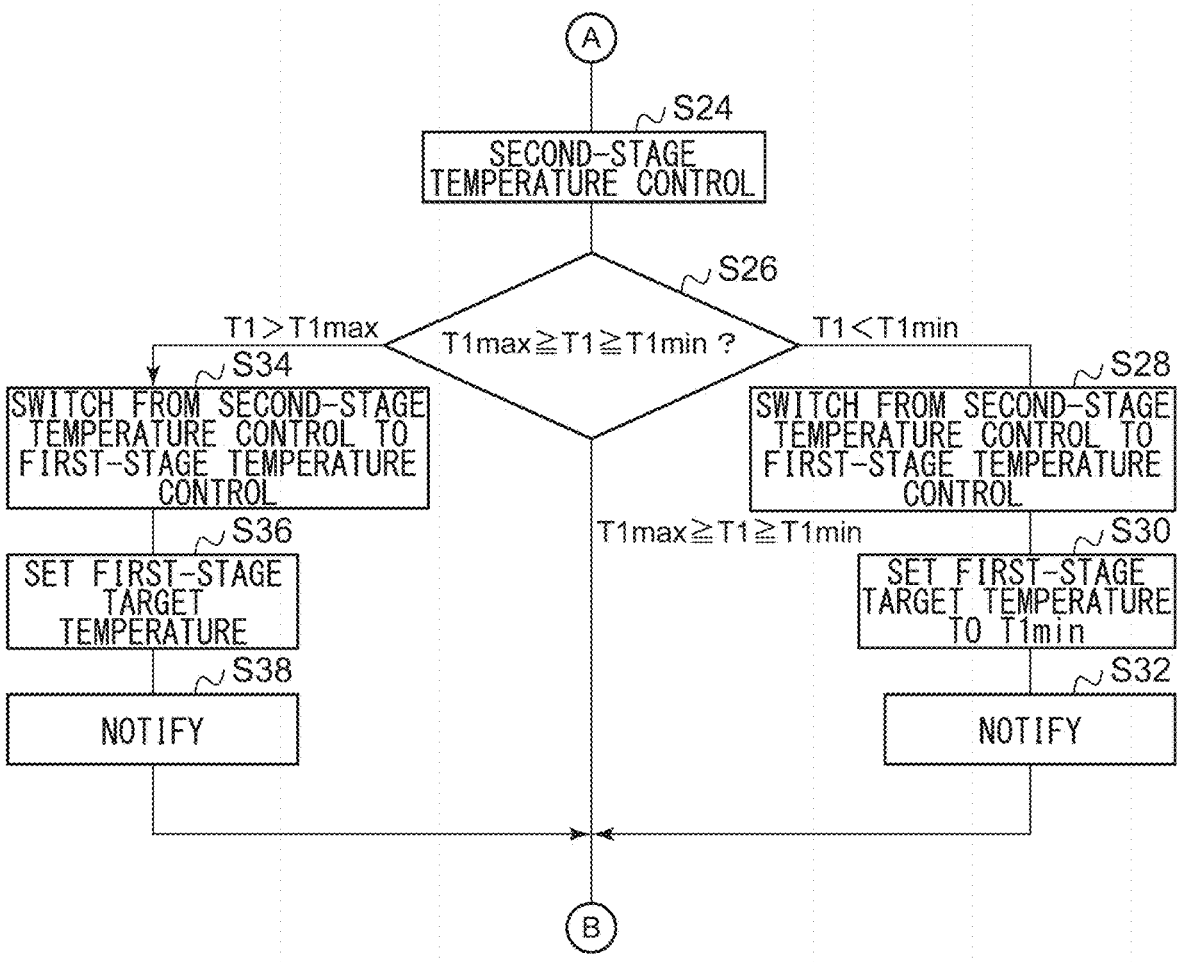
FIG. 5 is a flowchart showing the cryogenic pump control method according to the embodiment.

FIGS. 4 and 5 are flowcharts showing a method for controlling the cryogenic pump 10 according to an embodiment. In FIGS. 4 and 5, the switching processing between the first-stage temperature control and the second-stage temperature control is exemplified. The cryocooler control unit 102 periodically executes this processing during the evacuation operation of the cryogenic pump 10.

As shown in FIG. 4, if the processing is started, the temperature control unit 110 determines the operation state of the cryogenic pump 10 (S10). The temperature control unit 110 determines whether the temperature control selected at present is the first-stage temperature control or the second-stage temperature control. In the control device 100, an operation state flag corresponding to each of a plurality of different operation states may be determined in advance. The storage unit 104 may store these operation state flags. The control device 100 may store a first-stage temperature control flag in a case where the temperature control selected at present is the first-stage temperature control, and store a second-stage temperature control flag in a case where the temperature control selected at present is the second-stage temperature control. The temperature control unit 110 may determine the operation state of the cryogenic pump 10 with reference to such an operation state flag.

In a case where the first-stage temperature control is selected at present (I in S10), the temperature control unit 110 executes the first-stage temperature control (S12). The temperature control unit 110 acquires, for example, the measured temperature of the first temperature sensor 90 as the first-stage cooling temperature. The temperature control unit 110 controls the operation frequency of the cryocooler motor 80, based on the acquired first-stage cooling temperature and the first-stage target temperature set in advance. Further, together with the operation frequency of the cryocooler motor 80 (or instead of the operation frequency of the cryocooler motor 80), the temperature control unit 110 may control the output (for example, a heater current) of the first heater 94 and/or the second heater 96, based on the acquired first-stage cooling temperature and the first-stage target temperature set in advance.

The first-stage target temperature is selected from, for example, a temperature range of 60 K to 100 K or a temperature range of 65 K to 80 K. The first-stage target temperature may be 80 K, for example. The first-stage target temperature may be 65 K, for example.

The second-stage temperature monitoring unit 114 determines whether or not the second-stage cooling temperature T2 is equal to or lower than the predetermined second-stage upper limit temperature T2max, during the execution of the first-stage temperature control (S14). The second-stage temperature monitoring unit 114 acquires, for example, the measured temperature of the second temperature sensor 92 as the second-stage cooling temperature. The second-stage temperature monitoring unit 114 compares the acquired second-stage cooling temperature T2 with the second-stage upper limit temperature T2max set in advance. In this way, an increase in the second-stage cooling temperature T2 is detected during the execution of the first-stage temperature control. In a case where the second-stage cooling temperature T2 is equal to or lower than the second-stage upper limit temperature T2max (Y in S14), this processing is ended. The switching from the first-stage temperature control to the second-stage temperature control is not performed.

In this way, in a case where the second-stage cooling temperature T2 is equal to or lower than the second-stage upper limit temperature T2max during the execution of the first-stage temperature control, the temperature control unit 110 continues the first-stage temperature control. In a case where the exhaust capacity of the cryogenic pump 10 is at a normal level, the second-stage cooling temperature T2 will be lower than the second-stage upper limit temperature T2max. Therefore, when the cryogenic pump 10 is operating normally, the first-stage temperature control is performed.

On the other hand, in a case where the second-stage cooling temperature T2 exceeds the second-stage upper limit temperature T2max (N in S14), the temperature control unit 110 switches from the first-stage temperature control to the second-stage temperature control (S20). The second-stage target temperature which is used in the second-stage temperature control is set to the second-stage upper limit temperature T2max. The second-stage temperature control flag is set and stored in the storage unit 104. Further, the value of the first-stage target temperature set in the first-stage temperature control is stored in the storage unit 104. The notification unit 116 notifies the user that the switching from the first-stage temperature control to the second-stage temperature control has been performed in the temperature control unit 110 (S22). In this way, the first-stage temperature control is ended and the second-stage temperature control is started.

In FIG. 5, the processing subsequent to S10 in FIG. 4 is shown. In a case where the second-stage temperature control is selected at present (II in S10 of FIG. 4), the temperature control unit 110 executes the second-stage temperature control (S24). The temperature control unit 110 acquires, for example, the measured temperature of the second temperature sensor 92 as the second-stage cooling temperature T2. The temperature control unit 110 controls the operation frequency of the cryocooler motor 80, based on the acquired second-stage cooling temperature T2 and the second-stage target temperature set in advance (that is, the second-stage upper limit temperature T2max). Further, together with the operation frequency of the cryocooler motor 80 (or instead of the operation frequency of the cryocooler motor 80), the temperature control unit 110 may control the output (for example, a heater current) of the first heater 94 and/or the second heater 96, based on the acquired second-stage cooling temperature T2 and the second-stage target temperature set in advance.

The first-stage temperature monitoring unit 112 determines whether or not the first-stage cooling temperature T1 is within a temperature range between a temperature equal to or higher than the predetermined first-stage lower limit temperature T1min and a temperature equal to or lower than the predetermined first-stage upper limit temperature T1max, during the execution of the second-stage temperature control (S26). The first-stage temperature monitoring unit 112 acquires, for example, the measured temperature of the first temperature sensor 90 as the first-stage cooling temperature. The first-stage temperature monitoring unit 112 compares the acquired first-stage cooling temperature T1 with the first-stage lower limit temperature T1min set in advance. In this way, an excessive decrease in the first-stage cooling temperature T1 is detected during the execution of the second-stage temperature control. Further, the first-stage temperature monitoring unit 112 compares the acquired first-stage cooling temperature T1 with the first-stage upper limit temperature T1max set in advance. In this way, an excessive increase in the first-stage cooling temperature T1, which can temporarily occur during the execution of the second-stage temperature control, is detected. The first-stage upper limit temperature T1max may be equal to, for example, the value of the first-stage target temperature set in the latest first-stage temperature control.

In a case where the first-stage cooling temperature T1 is equal to or higher than the first-stage lower limit temperature T1min and equal to or lower than the first-stage upper limit temperature T1max (T1max≥T1≥T1min in S26), this processing is ended. The switching from the second-stage temperature control to the first-stage temperature control is not performed.

In this way, in a case where the first-stage cooling temperature T1 is within a temperature range between a temperature equal to or higher than the first-stage lower limit temperature T1min and a temperature equal to or lower than the first-stage upper limit temperature T1max during the execution of the second-stage temperature control, the temperature control unit 110 continues the second-stage temperature control. Since the second-stage target temperature is set to the second-stage upper limit temperature T2max, the second-stage cooling temperature T2 can be maintained at the second-stage upper limit temperature T2max. This means that under the second-stage temperature control, the cooling capacity of the second stage of the cryocooler 16 has been increased so as to counter the temperature rising tendency of the second stage described with reference to FIG. 3.

On the other hand, in a case where the first-stage cooling temperature T1 falls below the first-stage lower limit temperature T1min (T1<T1min in S26), the temperature control unit 110 switches from the second-stage temperature control to the first-stage temperature control (S28). In this way, the cryogenic pump 10 returns from the second-stage temperature control to the first-stage temperature control. The first-stage target temperature which is used in the first-stage temperature control after the return is set to the first-stage lower limit temperature T1min (S30). The first-stage temperature control flag is set and stored in the storage unit 104. The notification unit 116 notifies the user that the switching from the second-stage temperature control to the first-stage temperature control has been performed in the temperature control unit 110 (S32). The second-stage temperature control is ended and the first-stage temperature control is started.

Since the first-stage target temperature which is used in the first-stage temperature control after the return is lower than the first-stage target temperature which is used in the initial first-stage temperature control, the refrigerating capacity of the first stage of the cryocooler 16 is increased. The first-stage target temperature which is used in the first-stage temperature control after the return may be different from the first-stage lower limit temperature T1min. The first-stage target temperature which is used in the first-stage temperature control after the return may be lower than the first-stage target temperature which is used in the initial first-stage temperature control and higher than the first-stage lower limit temperature T1min.

In a case where the first-stage cooling temperature T1 exceeds the first-stage upper limit temperature T1max (T1>T1max in S26), the temperature control unit 110 switches from the second-stage temperature control to the first-stage temperature control (S34). In this way, the cryogenic pump 10 returns from the second-stage temperature control to the first-stage temperature control. The first-stage target temperature which is used in the first-stage temperature control after the return is set to the original first-stage target temperature, that is, the value of the first-stage target temperature set in the latest first-stage temperature control (S36). The first-stage temperature control flag is set and stored in the storage unit 104. The notification unit 116 notifies the user that the switching from the second-stage temperature control to the first-stage temperature control has been performed in the temperature control unit 110 (S38). The second-stage temperature control is ended and the first-stage temperature control is started.

It is not essential that the timing of the notification or alarm by the notification unit 116 be the same time as the switching between the first-stage temperature control and the second-stage temperature control. There can be various timings. For example, the notification timing may be when the amount of decrease in the first-stage cooling temperature that occurs after the start of the second-stage temperature control exceeds a threshold (for example, about 10 K), when the operation frequency of the cryocooler 16 exceeds a predetermined value during the execution of the second-stage temperature control, or when the output of the first heater 94 falls below a predetermined value during the execution of the second-stage temperature control. The notification unit 116 may generate a multi-stage alarm such as giving notice of a first alarm at the point in time of the switching between the first-stage temperature control and the second-stage temperature control and then giving notice of a second alarm. The notice of the second alarm may be given when the amount of decrease in the first-stage cooling temperature that occurs after the start of the second-stage temperature control exceeds a threshold (for example, about 10 K), when the operation frequency of the cryocooler 16 exceeds a predetermined value during the execution of the second-stage temperature control, or when the output of the first heater 94 falls below a predetermined value during the execution of the second-stage temperature control.

If necessary, the timing of the notification or alarm by the notification unit 116 may be before the switching from the second-stage temperature control to the first-stage temperature control. For example, the notification unit 116 may issue a notification or an alarm in a case where the first-stage cooling temperature T1 falls below a threshold temperature slightly higher than the first-stage lower limit temperature T1min during the execution of the second-stage temperature control. The threshold temperature may be, for example, a temperature 1 K to 5 K higher than the first-stage lower limit temperature T1min. In this way, the notification or the alarm may be issued in advance before the return from the second-stage temperature control to the first-stage temperature control.

Figure 6:
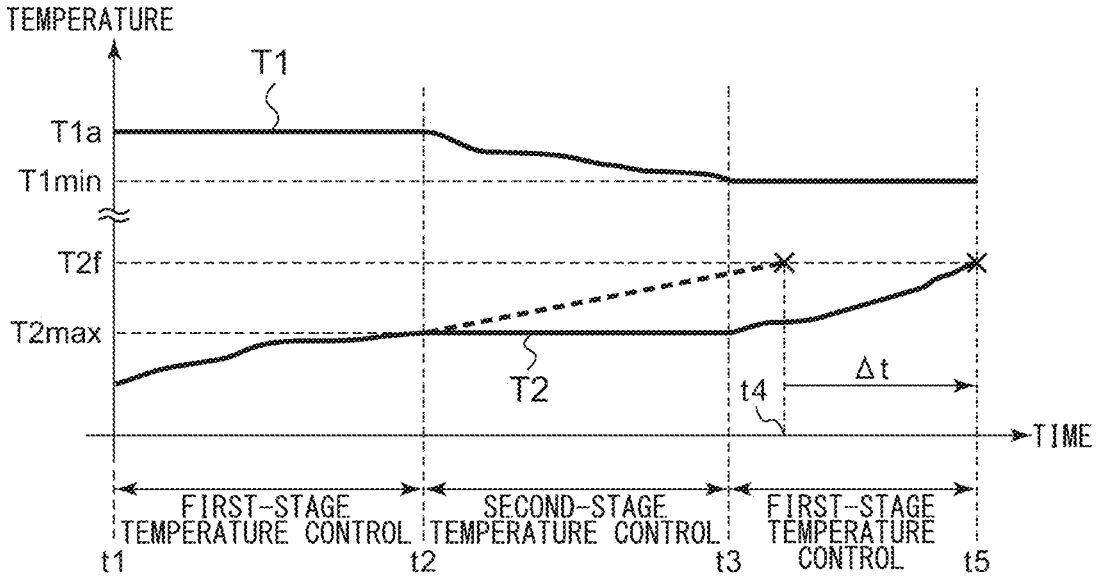
FIG. 6 is a diagram showing an example of a temperature profile which can be taken as a result of using the cryogenic pump according to the embodiment for a long period of time.

FIG. 6 is a diagram showing an example of a temperature profile which can be taken as a result of using the cryogenic pump 10 according to the embodiment for a long period of time. In the cryogenic pump 10, the control processing shown in FIG. 5 is executed. Here, the refrigerating capacity of the cryocooler 16 is controlled with the inverter method. Similar to FIG. 3, the vertical and horizontal axes in FIG. 6 respectively represent temperature and time. In FIG. 6, for comparison, the temperature profile shown in FIG. 3 is shown by a broken line.

Also in the case shown in FIG. 6, similar to the case shown in FIG. 3, the cooling capacity of the cryocooler 16 that cools the cryogenic pump 10 gradually deteriorates due to long-term use. While the first-stage temperature control is being executed, although the first-stage cooling temperature T1 is maintained at an initial first-stage target temperature T1*a*, the second-stage cooling temperature T2 gradually increases (from time t1 to time t2).

Incidentally, in FIG. 6, unlike FIG. 3, if the second-stage cooling temperature T2 increases to the second-stage upper limit temperature T2max (time t2), the temperature control of the cryogenic pump 10 is switched from the first-stage temperature control to the second-stage temperature control. While the second-stage temperature control is being performed, although the second-stage cooling temperature T2 is maintained at the second-stage upper limit temperature T2max, the first-stage cooling temperature T1 is gradually lowered (from time t2 to time t3). This is because the second-stage temperature control is executed due to the switching from the first-stage temperature control to the second-stage temperature, whereby the cooling capacity of the second stage of the cryocooler 16 is increased so as to suppress the temperature rising tendency as shown by the broken line in FIG. 6. If the cooling capacity of the second stage of the cryocooler 16 is increased, the cooling capacity of the first stage is also increased, and therefore, the first-stage cooling temperature T1 is lowered.

Thereafter, if the first-stage cooling temperature T1 falls to the first-stage lower limit temperature T1min (time t3), the temperature control of the cryogenic pump 10 is switched from the second-stage temperature control to the first-stage temperature control again. Here, since the first-stage target temperature which is used in the first-stage temperature control is the first-stage lower limit temperature T1min, the first-stage cooling temperature T1 is maintained at the first-stage lower limit temperature T1min. The second-stage cooling temperature T2 gradually increases again (time t3 to t5). If the second-stage cooling temperature T2 reaches the operation stop temperature T2*f*, the operation of the cryogenic pump 10 is stopped (time t5).

As understood from FIG. 6, the operation stop time t5 of the cryogenic pump 10 is later than an operation stop time t4 of the typical cryogenic pump shown by a broken line. That is, the life of the cryogenic pump 10 according to an embodiment is extended by Δt (=t5−t4) compared to the typical cryogenic pump.

According to this embodiment, the cryogenic pump 10 can detect an increase in the second-stage cooling temperature T2 during the execution of the first-stage temperature control and increase the cooling capacity of the cryocooler 16. Specifically, in a case where the second-stage cooling temperature T2 exceeds the second-stage upper limit temperature T2max during the execution of the first-stage temperature control, the first-stage temperature control is ended and the second-stage temperature control is started.

Thereby, an increase in the second-stage cooling temperature can be delayed compared to a case where the first-stage temperature control is continued as it is without increasing refrigerating capacity. The time at which the second-stage cooling temperature T2 of the cryogenic pump 10 reaches the operation stop temperature T2*f* of the cryogenic pump 10 can be extended. In this way, the life of the cryogenic pump 10 can be extended to some extent. It becomes possible to continue the operation of the cryogenic pump 10 while suppressing the deterioration of the exhaust performance, preferably until the planned maintenance time.

Figure 7:
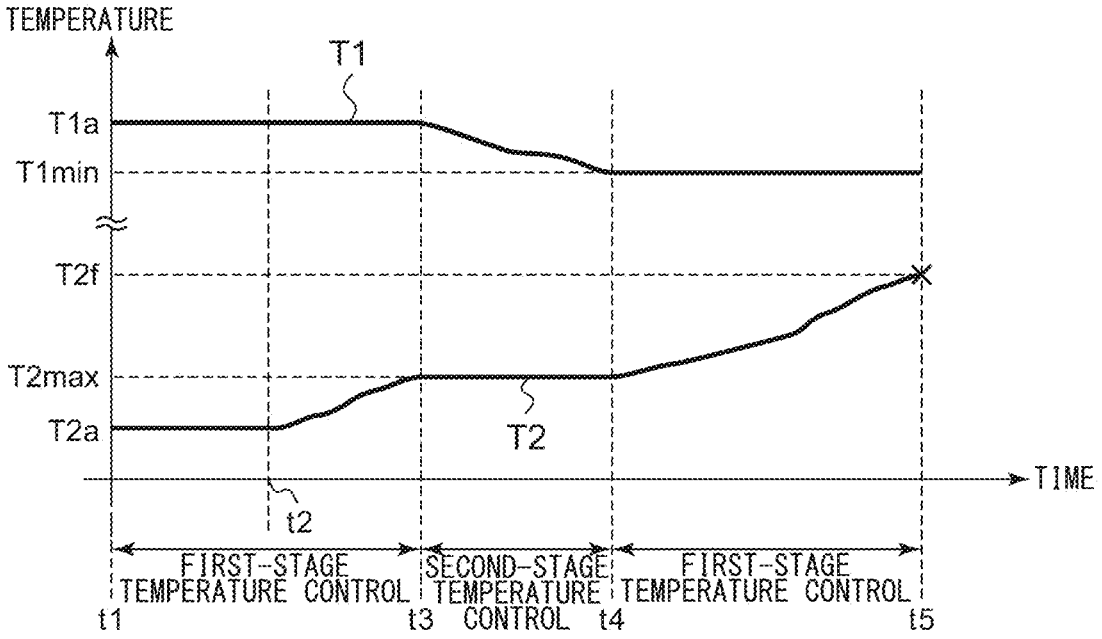
FIG. 7 is a diagram showing another example of the temperature profile which can be taken as a result of using the cryogenic pump according to the embodiment for a long period of time.

FIG. 7 is a diagram showing another example of the temperature profile which can be taken as a result of using the cryogenic pump 10 according to the embodiment for a long period of time. In the cryogenic pump 10, the control processing shown in FIG. 5 is executed. Here, the refrigerating capacity of the cryocooler 16 is controlled with the heater method. The present invention is applicable to not only a case where the refrigerating capacity of the cryocooler 16 is controlled with the inverter method, but also a case where the refrigerating capacity of the cryocooler 16 is controlled with the heater method.

Also in the case shown in FIG. 7, similar to the case shown in FIG. 3, the cooling capacity of the cryocooler 16 that cools the cryogenic pump 10 gradually deteriorates due to long-term use. While the first-stage temperature control is being executed, the first-stage cooling temperature T1 is maintained at the initial first-stage target temperature T1*a* (from time t1 to time t3). In the normal operation state of the cryogenic pump 10 in which there is a margin in the cooling capacity of the second stage of the cryocooler 16, the second heater 96 is operated, whereby the second-stage cooling temperature T2 can be controlled independently of the first-stage cooling temperature T1. In this way, during the execution of the first-stage temperature control, not only the first-stage cooling temperature T1 but also the second-stage cooling temperature T2 can be maintained at a second-stage target temperature T2*a*.

In order to maintain the second-stage cooling temperature T2 at the second-stage target temperature T2*a*, the temperature control unit 110 lowers the output of the second heater 96 as the cooling capacity of the second stage of the cryocooler 16 deteriorates, and finally turns off the second heater 96 (time t2). Thereafter, while the first-stage temperature control is being executed, although the first-stage cooling temperature T1 is maintained at the initial first-stage target temperature T1*a*, the second-stage cooling temperature T2 gradually increases (from time t2 to time t3).

If the second-stage cooling temperature T2 rises to the second-stage upper limit temperature T2max (time t3), the temperature control of the cryogenic pump 10 is switched from the first-stage temperature control to the second-stage temperature control. In the second-stage temperature control, the temperature control unit 110 controls the second-stage cooling temperature T2 by controlling the first heater 94. If the output of the first heater 94 is lowered, the first-stage cooling temperature T1 is lowered and the heat inflow from the first stage to the second stage is reduced. For this reason, the cooling capacity of the second stage of the cryocooler 16 increases, and the second-stage cooling temperature T2 is lowered. Conversely, if the output of the first heater 94 is increased, the cooling capacity of the second stage of the cryocooler 16 is lowered and the second-stage cooling temperature T2 rises.

While the second-stage temperature control is being performed, although the second-stage cooling temperature T2 is maintained at the second-stage upper limit temperature T2max, the first-stage cooling temperature T1 is gradually lowered (from time t3 to time t4). This is because the second-stage temperature control is executed due to the switching from the first-stage temperature control to the second-stage temperature control, whereby the cooling capacity of the cryocooler 16 is increased so as to suppress the above-described temperature rising tendency associated with the temporal deterioration of the cryogenic pump 10.

Thereafter, if the first-stage cooling temperature T1 falls to the first-stage lower limit temperature T1min (time t4), the temperature control of the cryogenic pump 10 is switched from the second-stage temperature control to the first-stage temperature control again. Here, since the first-stage target temperature which is used in the first-stage temperature control is the first-stage lower limit temperature T1min, the first-stage cooling temperature T1 is maintained at the first-stage lower limit temperature T1min. The second-stage cooling temperature T2 gradually increases again (time t4 to t5). If the second-stage cooling temperature T2 reaches the operation stop temperature T2*f*, the operation of the cryogenic pump 10 is stopped (time t5).

In this manner, the present invention is applicable to not only a case where the cooling capacity of the cryocooler 16 is controlled with the inverter method, but also a case where the cooling capacity of the cryocooler 16 is controlled with the heater method.

Figure 8:
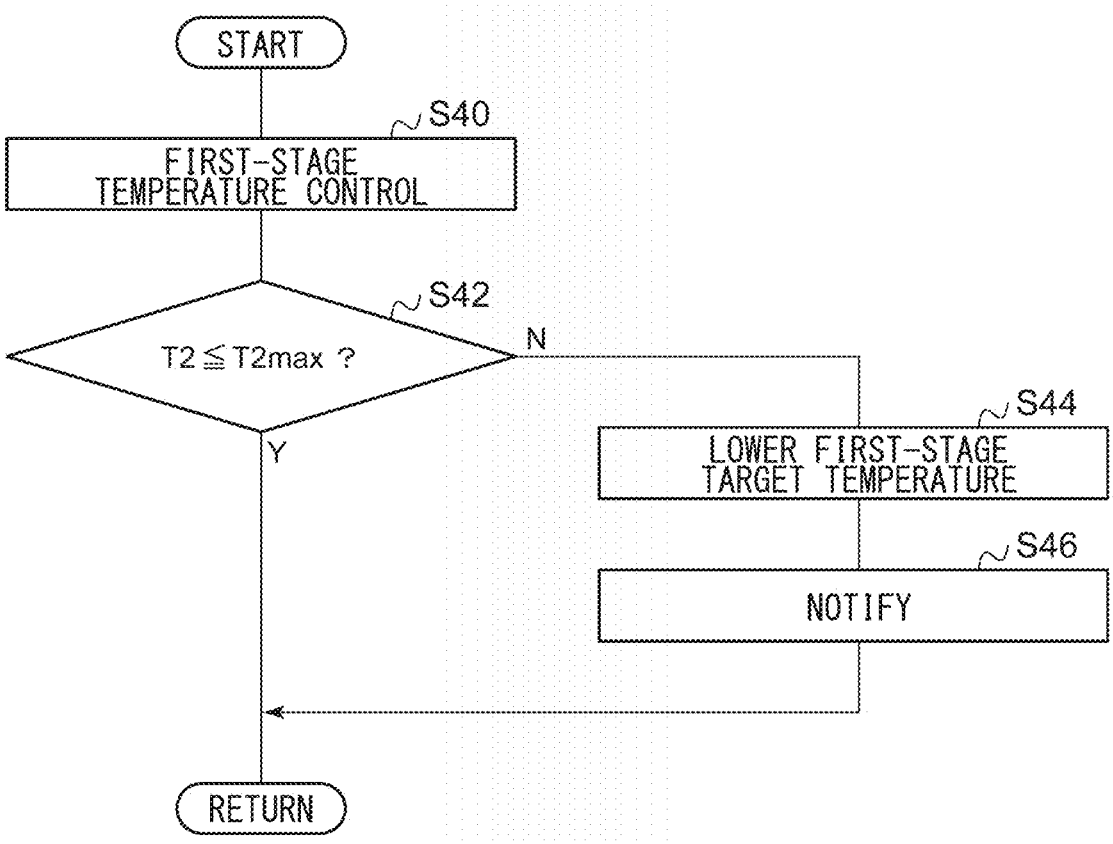
FIG. 8 is a flowchart showing a cryogenic pump control method according to another embodiment.

FIG. 8 is a flowchart showing a method for controlling the cryogenic pump 10 according to another embodiment. The control device 100 is configured to detect an increase in the second-stage cooling temperature during the execution of the first-stage temperature control and lower the first-stage target temperature. Unlike the embodiment described above, instead of the switching from the first-stage temperature control to the second-stage temperature control, the first-stage temperature control is continued even if an increase in the second-stage cooling temperature is detected. The cooling capacity of the cryocooler 16 is increased by lowering the first-stage target temperature.

As shown in FIG. 8, the temperature control unit 110 executes the first-stage temperature control (S40). The second-stage temperature monitoring unit 114 determines whether or not the second-stage cooling temperature T2 is equal to or lower than a predetermined second-stage upper limit temperature T2max, during the execution of the first-stage temperature control (S42). In a case where the second-stage cooling temperature T2 is equal to or lower than the second-stage upper limit temperature T2max (Y in S42), this processing is ended. The first-stage target temperature is not changed.

In a case where the second-stage cooling temperature T2 exceeds the second-stage upper limit temperature T2max (N in S42), the temperature control unit 110 lowers the first-stage target temperature (S44). For example, the temperature control unit 110 changes the first-stage target temperature to the first-stage lower limit temperature T1min. Alternatively, the temperature control unit 110 may change the first-stage target temperature to a temperature value between the current first-stage target temperature and the first-stage lower limit temperature T1min. In this way, in the subsequent first-stage temperature control, the changed first-stage target temperature is used. In a case where the first-stage target temperature has already been lowered to the first-stage lower limit temperature T1min, the temperature control unit 110 does not change the first-stage target temperature.

The notification unit 116 notifies the user that the first-stage target temperature has been lowered in the temperature control unit 110 (S46). In this way, this processing is ended. Thereafter, this processing is periodically executed during the evacuation operation of the cryogenic pump 10.

Even in this way, the cryogenic pump 10 can detect an increase in the second-stage cooling temperature T2 during the execution of the first-stage temperature control and increase the cooling capacity of the cryocooler 16. Thereby, it is possible to extend the life of the cryogenic pump 10 to some extent. It becomes possible to continue the operation of the cryogenic pump 10 while suppressing the deterioration of the exhaust performance, preferably until the planned maintenance time.

The control processing shown in FIG. 8 can also be combined with the control processing shown in FIGS. 4 and 5. The second-stage temperature monitoring unit 114 may determine whether or not the second-stage cooling temperature T2 is equal to or lower than a predetermined temperature threshold, during the execution of the first-stage temperature control. The temperature threshold may be lower than the second-stage upper limit temperature T2max. The temperature control unit 110 may maintain the first-stage target temperature in a case where the second-stage cooling temperature T2 is equal to or lower than the temperature threshold, and lower the first-stage target temperature in a case where the second-stage cooling temperature T2 exceeds the temperature threshold. In this way, for example, at the time t2 to time t3 shown in FIG. 7, it is possible to lower the first-stage target temperature and suppress an increase in the second-stage cooling temperature.

The present invention has been described above based on the examples. It will be understood by those skilled in the art that the present invention is not limited to the embodiments described above, various design changes can be made, various modification examples can be made, and such modification examples are also within the scope of the present invention.

The present invention can be used in the fields of a cryogenic pump and a method for controlling a cryogenic pump.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a first-stage cryopanel;

a second-stage cryopanel;

a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature;

a first temperature sensor configured to measure the first-stage cooling temperature;

a second temperature sensor configured to measure the second-stage cooling temperature; and a cryocooler controller connected to the first temperature sensor and the second temperature sensor to receive the first-stage cooling temperature and the second-stage cooling temperature measured by the first temperature sensor and the second temperature sensor, respectively, wherein the cryocooler controller configured to:

execute a first-stage temperature control for controlling the first-stage cooling temperature to a first-stage target temperature;

increase cooling capacity of the cryocooler when an increase in the second-stage cooling temperature is detected during the execution of the first-stage temperature control;

execute the first-stage temperature control and a second-stage temperature control for controlling the second-stage cooling temperature to a second-stage target temperature; and switch from the first-stage temperature control to the second-stage temperature control when an increase in the second-stage cooling temperature is detected during the execution of the first-stage temperature control, wherein the cryocooler controller includes:

a second-stage temperature monitor configured to:

determine whether or not the second-stage cooling temperature exceeds a predetermined second-stage upper limit temperature, during the execution of the first-stage temperature control, and a temperature controller configured to:

execute the first-stage temperature control and the second-stage temperature control; and switch from the first-stage temperature control to the second-stage temperature control in a case where the second-stage cooling temperature exceeds the predetermined second-stage upper limit temperature during the execution of the first-stage temperature control.

2. The cryopump according to claim 1, wherein the temperature controller configured to continue the first-stage temperature control in a case where the second-stage cooling temperature is equal to or lower than the predetermined second-stage upper limit temperature during the execution of the first-stage temperature control.

3. The cryopump according to claim 1, wherein the cryocooler controller includes a first-stage temperature monitor configured to determine whether or not the first-stage cooling temperature falls below a predetermined first-stage lower limit temperature, during the execution of the second-stage temperature control, and the temperature controller is configured to switch from the second-stage temperature control to the first-stage temperature control in a case where the first-stage cooling temperature falls below the predetermined first-stage lower limit temperature.

4. The cryopump according to claim 3, wherein the temperature controller is configured to continue the second-stage temperature control in a case where the first-stage cooling temperature is equal to or higher than the predetermined first-stage lower limit temperature during the execution of the second-stage temperature control.

5. The cryopump according to claim 1, wherein the cryocooler controller is configured to notify a user of switching from the first-stage temperature control to the second-stage temperature control.

6. The cryopump according to claim 1, wherein the cryocooler controller is configured to lower the first-stage target temperature when an increase in the second-stage cooling temperature is detected during the execution of the first-stage temperature control.

7. A method for controlling a cryopump, the cryopump including a first-stage cryopanel, a second-stage cryopanel, and a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature, the method comprising:

executing first-stage temperature control for controlling the first-stage cooling temperature to a first-stage target temperature; and increasing cooling capacity of the cryocooler when an increase in the second-stage cooling temperature is detected during the execution of the first-stage temperature control, wherein the increasing comprises:

switching from the first-stage temperature control to a second-stage temperature control for controlling the second-stage cooling temperature to a second-stage target temperature when an increase in the second-stage cooling temperature is detected during the execution of the first-stage temperature control, wherein the switching comprises:

determining whether or not the second-stage cooling temperature exceeds a predetermined second-stage upper limit temperature, during the execution of the first-stage temperature control, and switching from the first-stage temperature control to the second-stage temperature control in a case where the second-stage cooling temperature exceeds the predetermined second-stage upper limit temperature during the execution of the first-stage temperature control.

8. A cryopump comprising:

a first-stage cryopanel;

a second-stage cryopanel;

a cryocooler thermally coupled to the first-stage cryopanel and the second-stage cryopanel to cool the first-stage cryopanel to a first-stage cooling temperature and cool the second-stage cryopanel to a second-stage cooling temperature that is lower than the first-stage cooling temperature;

a first temperature sensor configured to measure the first-stage cooling temperature;

a second temperature sensor configured to measure the second-stage cooling temperature; and a cryocooler controller connected to the first temperature sensor and the second temperature sensor to receive the first-stage cooling temperature and the second-stage cooling temperature measured by the first temperature sensor and the second temperature sensor, respectively, the cryocooler controller configured to:

execute a second-stage temperature control for controlling the second-stage cooling temperature to a second-stage target temperature; and determine whether or not the first-stage cooling temperature is in a temperature range between a predetermined first-stage lower limit temperature and a predetermined first-stage upper limit temperature, during the execution of the second-stage temperature control.

9. The cryopump according to claim 8, wherein the cryocooler controller is configured to switch from the second-stage temperature control to a first-stage temperature control for controlling the first-stage cooling temperature to a first-stage target temperature in a case where the first-stage cooling temperature falls below the first-stage lower limit temperature.

10. The cryopump according to claim 8, wherein the cryocooler controller is configured to switch from the second-stage temperature control to a first-stage temperature control for controlling the first-stage cooling temperature to a first-stage target temperature in a case where the first-stage cooling temperature exceeds the first-stage upper limit temperature.

* * * * *